United States Patent [19]

Holley

[11] 4,014,532

[45] Mar. 29, 1977

[54] LADLE REFRACTORY LINING PREHEATER

[76] Inventor: Carl A. Holley, 116 Marian Ave., Glenshaw, Pa. 15116

[22] Filed: Jan. 2, 1976

[21] Appl. No.: 646,407

[52] U.S. Cl. ..... 266/287

[51] Int. Cl.[2] ..... F27B 14/00

[58] Field of Search ..... 266/287; 432/88

[56] References Cited

UNITED STATES PATENTS

| | | | |
|---|---|---|---|
| 2,042,626 | 6/1936 | Pontzen | 432/88 X |
| 3,491,988 | 1/1970 | Anderson | 432/88 X |
| 3,907,260 | 9/1975 | Leatherby | 266/287 |

*Primary Examiner*—John E. Roethel
*Attorney, Agent, or Firm*—William J. Ruano

[57] ABSTRACT

A preheater for uniformly heating the refractory lining of a ladle, ingot mold or the like. A concave, refractory lined cover is provided with one or more flues for exhausting noxious fumes and products of combustion. There is also provided an axially extending burner for projecting a flame onto the walls of the ladle refractory lining. Fluid operated means are provided for vertically tilting the boom which pivotally supports the ladle cover to enable the cover to be laid, with a tight fit, on the mouth portion of the ladle, - also to enable lifting of the cover and lateral swinging thereof from the closed position. A modification, particularly suitable for large ladles, is to provide a plurality of burners which emit flames substantially tangentially inwardly of the cover to uniformly heat the ladle lining.

4 Claims, 6 Drawing Figures

LADLE REFRACTORY LINING PREHEATER

This invention relates to improvements in apparatus for uniformly heating the refractory lining of ladles, ingot molds and the like.

An outstanding disadvantage of ladle preheaters used in the past, such as that shown in U.S. Pat. No. 3,907,260, dated Sept. 25, 1975, is that by virtue of necessity of maintaining the ladle cover in spaced relationship with respect to the mouth of the ladle in order to allow exhaust gases to escape from the ladle, a very dangerous condition was created since such fumes would flow towards nearby workers, also spattering from the interior of the ladle would likewise be projected towards the workers subjecting them to serious injury.

Another disadvantage of prior devices, such as shown in the abovementioned patent, is that very complicated motor drive means are used for vertical and horizontally controlling movements of the ladle cover which unnecessarily add to costs and maintenance of the apparatus.

An object of the present invention is to overcome the abovenamed disadvantages of prior devices, such as exemplified in the aforesaid U.S. Pat. No. 3,907,260, by the provision of exhaust flues in the ladle cover to safely remove exhaust fumes and spattering while the ladle cover is held tightly closed, instead of in vertically spaced relationship with respect to the mouth of the refractory lined ladle.

Another object of the present invention is to provide simplified means for pivotally raising and lowering the cover of the ladle as well as for moving it in a horizontal plane, in either direction, without the necessity of driving electric motors with gearing which add considerably to the cost as well as to the maintenance of the apparatus.

Another object of the present invention is to provide, particularly in larger apparatus, a plurality of burners substantially tangentially of the cover for more uniformly heating the refractory lining of the ladle.

Other objects and advantages will become more apparent with a study of the following description taken with the accompanying drawings wherein.

Figure 1:
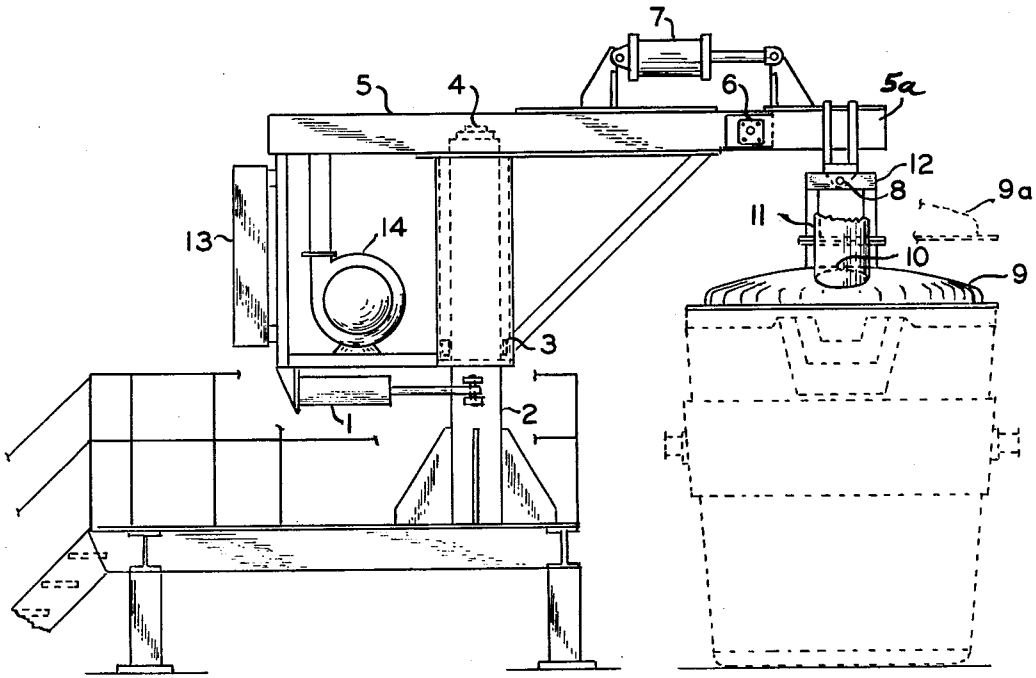
FIG. 1 is an elevational view of a ladle preheating apparatus embodying the principles of the present invention.

Referring more particularly to FIG. 1 of the drawing, numeral 1 denotes an air or hydraulic cylinder having an actuating rod end pivotally connected to a vertical pipe or post 2 rigidly secured to a framework constituting an elevated platform surrounded by a hand rail. Needle bearings 3 and roller thrust bearings 4 allow a surrounding sleeve rigidly secured to a boom 5 to rotate horizontally about the vertical axis of the pipe or post 2.

A hinge 6 allows the end portion 5*a* of the boom to be pivotally raised or lowered about the horizontal pivot of hinge 6 as the result of actuating movements of an air or hydraulic cylinder 7. On end portion 5*a*, there is suspended a support which is pivotally connected, by means of pivot 8, to a mounting frame 12 which supports a combustion burner 10, supplied by oil or gas, which projects centrally and axially into a concave ladle cover 9 provided with an interior refractory lining (not shown).

One, or preferably a pair of exhaust stacks 11 are provided in the ladle cover 9 to enable venting of exhaust fumes from the burner and as a consequence of spattering of the inner refractory lining of the ladle by the flame from burner 10. The ladle or ingot has a refractory inner lining shown in dotted outline. The exhaust stacks 11, one of which is broken away for clarity of illustration, can be of any desired height so as to exhaust gases well above the height of the ladle cover. Preferably, they are connected by flexible tubes (not shown) to a chimney or flue in the building.

Electrical control apparatus 13 is also mounted on the boom 5 for selectively controlling movements of the boom and ladle cover, — also the amount of heat applied by the burners.

In operation, when the air or hydraulic cylinder 7 is operated to retract the operating rod, it will tilt the boom end portion 5*a* upwardly about the horizontal axis of hinge 6 as a pivot and, by virtue of pivot 8, will raise the cover vertically but always with the mouth portion in a horizontal plane, as illustrated by the dash lines 9*a* which represent the raised position of the ladle cover or lid 9. Of course, when the cylinder 7 is operated to lower end portions 5*a*, the cover or head 9 will be moved to the closed position, as illustrated, so as to provide a substantially air-tight closure, particularly as aided by the free pivotal movement about axis 8 which will automatically compensate for inaccuracies in levelling. It will be understood that instead of hydraulic cylinder or air cylinder 7, a linear motor, reversible gear motor or other electrically driven device may be used instead.

Figure 2:
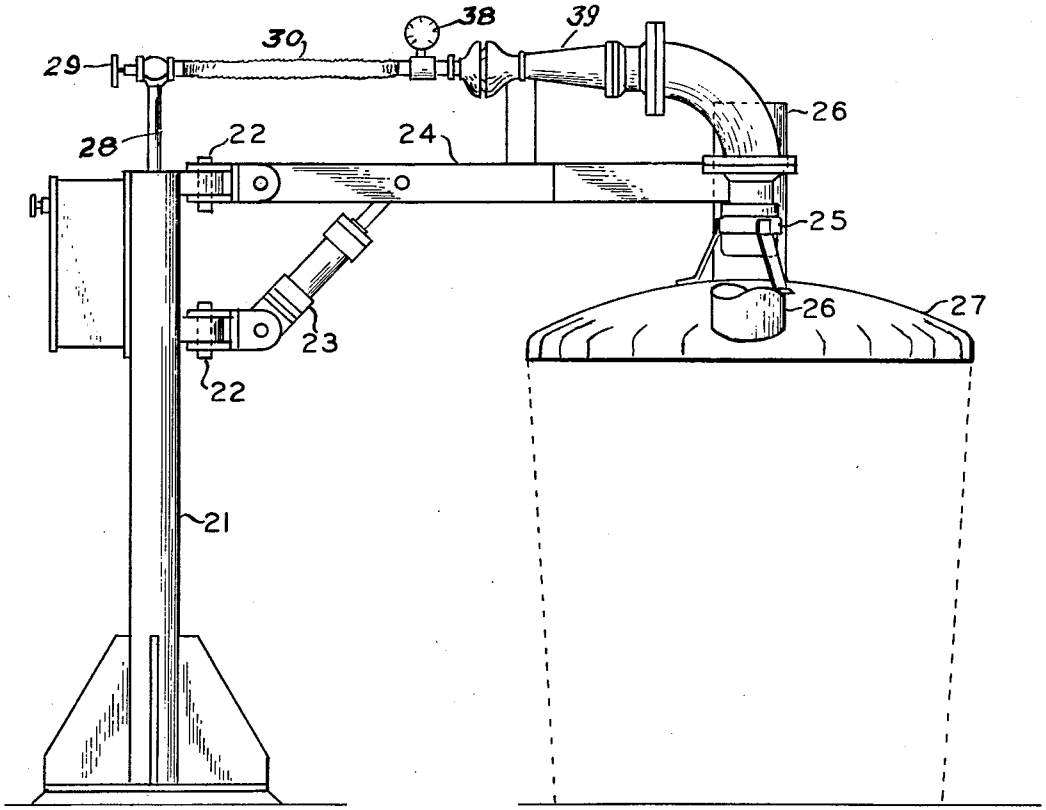
FIG. 2 is an elevational view of a modification of the apparatus shown in FIG. 1.

FIG. 2 shows a modification employing the use of any already existing vertical column 21 in the plant, onto which are fastened two-way pivotal hinges 22,22 in vertically spaced relationship for allowing horizontal pivotal movement of a boom 24, as well as allowing a vertical pivotal movement of the boom 24 about the respective pivots at the right of the hinges 22, 22, as the result of operation of the hydraulic or air cylinder 23.

A combustion burner 25, fueled by oil or gas, projects a flame centrally and inwardly of the lid 27 of the ladle, while a pair of exhaust stacks 26, 26, one of which is shown broken away, will allow escape of the exhaust gases either to a high elevation or to an existing flue by connecting thereto by conduits, such as flexible conduits (not shown).

A gas inlet pipe 28 which is projected centrally through pipe 21, or alongside thereof, conducts gas, the flow which is controlled by needle valve 29. The gas flows through a steel flexible hose 30, thence through a pressure gauge 38 and a high pressure inspirator 39 into the burner 25.

Figure 4:
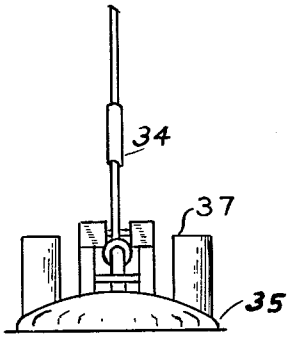
FIG. 4 is a side, elevational view as viewed from the right of FIG. 3.
Figure 3:
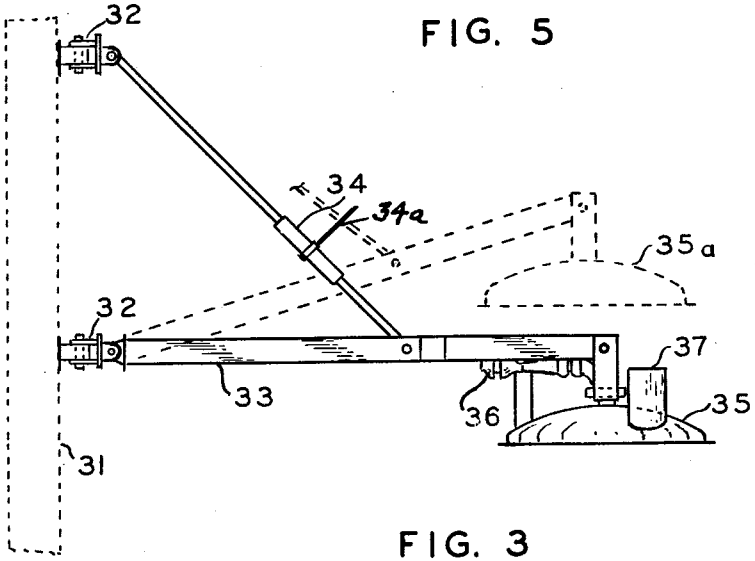
FIG. 3 is a further modification of the pivotal means for lifting and laterally swinging the ladle cover.

FIGS. 3 and 4 show a modification wherein an existing post or column 31 of the building has attached thereto, in vertically spaced relationship, two-way pivotal hinges 32. The boom 33 has one end pivoted to hinge 32 to enable vertical pivotal movement thereof, while on the other end there is suspended the cover 35 and burner 36. A lifting hydraulic or air cylinder 34 has one rod pivotally connected to an intermediate point of the boom 33 and the other rod pivotally connected to the upper two-way pivotal hinge 32.

Upon operation of the lifting cylinder 34, the boom 33 and ladle cover 35 are pivotally moved vertically to the dotted line position 35a and then horizontally to enable molten metal to be poured into the ladle (not shown). A pair of exhaust stacks 37 are provided in the ladle cover 35 for exhausting products of combustion and spattering from the refractory lining of the ladle. In some instances, instead of fluid cylinder 34, a ratchet turnbuckle may be used operable manually by a handle 34*a*.

Figure 6:
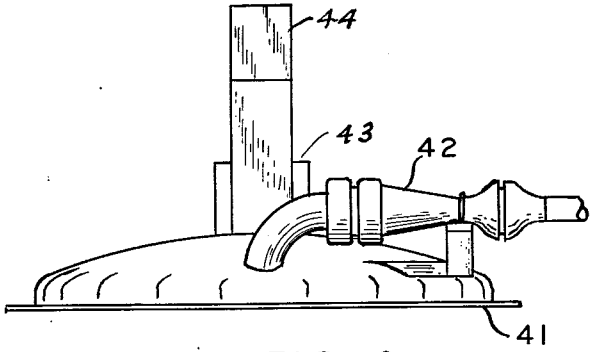
Figure 5:
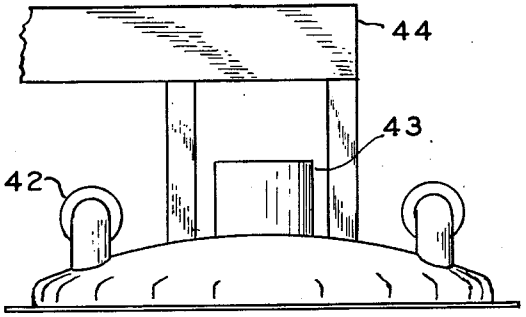
FIG. 5 shows a further modification of the ladle cover, particularly suitable for large ladles, embodying a plurality of burners disposed along the periphery thereof; and, FIG. 6 is a side, elevational view as viewed from the right of FIG. 5.

FIGS. 5 and 6 show a further modification of the ladle cover, particularly for use in larger ladles, which cover is suspended from the end of boom 44 and is provided with a central chimney or flue 43 for venting exhaust gases and the like. Such flue 43 may be also connected by a flexible conduit (not shown) to a permanent flue in the plant.

A plurality of burners 42 are provided in circumferentially spaced relationship along the periphery of the lid 41 to provide flames projecting substantially tangentially of the cover to enable more uniform distribution of the flames onto the refractory lining of the ladle or ingot mold (not shown).

Thus it will be seen that I have provided an efficient apparatus for uniformly heating the refractory ladle lining before molten metal is poured therein to minimize spattering and fracture of the lining, involving a high degree of safety by the provision of flues in the ladle cover for exhausting fumes and the like while the cover tightly covers the ladle, thereby giving maximum protection to nearby workmen; also which apparatus involves relatively inexpensive, yet highly efficient means for lifting and lowering the ladle cover so that the cover will always extend in a horizontal plane and thus provide assured seating on the mouth of the ladle or ingot mold when lowered to the closed position thereon; also I have provided a novel and efficient disposition of a plurality of burners along the circumference of the ladle to provide more uniform heating, particularly for linings of large ladles or ingot molds.

While I have illustrated and described several embodiments of my invention, it will be understood that these are by way of illustration only and that various changes or modifications may be contemplated in my invention and within the scope of the following claims.

I claim:

1. In combination with a ladle having an inner lining of refractory material, a preheater for uniformly heating said lining prior to introduction, into the ladle, of molten metal, comprising a ladle cover having a burner for projecting a flame into the cover in the direction of the ladle lining to preheat said lining, a vertical flue extending into the ladle cover for exhausting fumes developed therein, a boom including a horizontal pivot for pivotally suspending said cover and burner so that the cover will automatically remain in a horizontal plane irrespective of both lifting and lowering movements, and means for pivoting said boom in a vertical direction to effect selective lifting and lowering movements of said cover, means for effecting lateral movements of said boom about a vertical axis, throughout which movements said cover will always extend in a horizontal plane to enable tightly closing of said ladle by said cover.

2. Apparatus as recited in claim 1 together with a second vertical flue extending into said ladle cover, and including a vertical post and a pair of vertically spaced hinges attached thereto with vertical pivots to permit swinging of said boom in a horizontal plane, said first-mentioned means including a fluid operated cylinder interconnected between an intermediate portion of said boom, and a horizontal pivot integrally secured to the lowermost of said hinges to effect selective vertical tilting movement of said boom in either direction.

3. Apparatus as recited in claim 1 wherein a gas inlet pipe extends along said vertical post and is connected to a flexible pipe which supplies gas to said burner to enable said pivotal movements of said burner, and a needle valve positioned between said inlet pipe and said flexible pipe to regulate the flow thereof to said burner.

4. Apparatus as recited in claim 1 wherein said vertical flue extends centrally into said ladle cover and wherein a plurality of burners are provided along the periphery of said cover for projecting flames substantially tangentially into the lining of said ladle.

* * * * *